US009115468B2

(12) United States Patent
Xu

(10) Patent No.: US 9,115,468 B2
(45) Date of Patent: Aug. 25, 2015

(54) CHEMICAL TREATMENT OF LIGNOCELLULOSIC FIBER BUNDLE MATERIAL, AND METHODS AND SYSTEMS RELATING THERETO

(71) Applicant: ANDRITZ INC., Glens Falls, NY (US)

(72) Inventor: Eric Xu, Fairborn, OH (US)

(73) Assignee: Andritz Inc., Glen Falls, NY (US)

( * ) Notice: Subject to any disclaimer, the term of this patent is extended or adjusted under 35 U.S.C. 154(b) by 0 days.

(21) Appl. No.: 14/038,940

(22) Filed: Sep. 27, 2013

(65) Prior Publication Data

US 2014/0083633 A1 Mar. 27, 2014

Related U.S. Application Data

(60) Provisional application No. 61/706,238, filed on Sep. 27, 2012.

(51) Int. Cl.

| | |
|---|---|
| ***D21B 1/02*** | (2006.01) |
| ***D21B 1/16*** | (2006.01) |
| ***D21C 3/26*** | (2006.01) |
| ***D21B 1/12*** | (2006.01) |
| ***D21C 1/02*** | (2006.01) |
| ***D21C 3/02*** | (2006.01) |
| ***D21C 9/10*** | (2006.01) |
| ***D21C 9/16*** | (2006.01) |
| ***D21D 1/20*** | (2006.01) |

(52) U.S. Cl.

CPC *D21C 3/26* (2013.01); *D21B 1/021* (2013.01); *D21B 1/12* (2013.01); *D21B 1/16* (2013.01); *D21C 1/02* (2013.01); *D21C 3/02* (2013.01); *D21C 9/1042* (2013.01); *D21C 9/163* (2013.01); *D21D 1/20* (2013.01)

(58) Field of Classification Search

CPC ..... D21B 1/12; D21B 1/16; D21B 1/021
USPC ..... 162/24, 25
See application file for complete search history.

(56) References Cited

U.S. PATENT DOCUMENTS

| | | | |
|---|---|---|---|
| 3,900,334 | A | 8/1975 | Brink |
| 7,300,540 | B2 | 11/2007 | Sabourin et al. |
| 7,300,541 | B2 | 11/2007 | Sabourin |
| 7,300,550 | B2 | 11/2007 | Sabourin et al. |
| 8,048,263 | B2 | 11/2011 | Herkel et al. |
| 8,092,647 | B2 | 1/2012 | Akhtar et al. |
| 8,216,423 | B2 | 7/2012 | Xu |
| 2003/0102094 | A1 | 6/2003 | Tirri et al. |
| 2004/0069427 | A1 | 4/2004 | Xu |
| 2006/0006264 | A1 | 1/2006 | Sabourin et al. |
| 2008/0035286 | A1 | 2/2008 | Aichinger et al. |

(Continued)

OTHER PUBLICATIONS

Smook, Handbook for Pulp and Paper Technologists, 1992, Angus Wilde Publications, 2nd edition, chapters 5, 9, 11.*
U.S. Appl. No. 61/706,238, filed Sep. 27, 2012.

(Continued)

*Primary Examiner* — Anthony Calandra
(74) *Attorney, Agent, or Firm* — Kerri Hochgesang; Robert Joesph Hornung

(57) ABSTRACT

The present disclosure relates to a system and process in which pulp is produced using a chemical mechanical pulping process, during which lignocellulosic material undergoes fiberization without chemical impregnation. Chemical treatment of the lignocellulosic material is performed during or after fiberization of the material to become fiber bundles.

17 Claims, 2 Drawing Sheets

(56) References Cited

U.S. PATENT DOCUMENTS

| | | | |
|---|---|---|---|
| 2008/0227161 | A1 | 9/2008 | Levie et al. |
| 2009/0151880 | A1 | 6/2009 | Aichinger et al. |
| 2011/0262985 | A1 | 10/2011 | Medoff |

OTHER PUBLICATIONS

International Search Report and Written Opinion dated Feb. 19, 2014, in connection with corresponding PCT Application No. PCT/US2013/62195.

* cited by examiner

CHEMICAL TREATMENT OF LIGNOCELLULOSIC FIBER BUNDLE MATERIAL, AND METHODS AND SYSTEMS RELATING THERETO

RELATED APPLICATION

This invention claims the benefit of U.S. provisional patent application 61/706,238, filed on Sep. 27, 2012, the entirety of which is incorporated herein by reference.

TECHNICAL FIELD

The present disclosure generally relates to a system and process in which pulp is produced using a chemical mechanical pulping procedure, in which lignocellulosic material does not undergo chemical impregnation before being transformed into fiber-bundles. The lignocellulosic material undergoes chemical treatment during or after being transformed into fiber bundles and before further defiberization and/or fibrillation.

BACKGROUND OF THE DISCLOSURE

Mechanical pulping processes are known to use equipment to break apart the fibers of lignocellulosic material to produce pulp. Some processes combine mechanical refining and chemical treatment, which is known as chemical mechanical pulping (CMP). In an aspect, CMP processes are believed to reduce the possibility of adverse impact on the lignocellulosic material that occurs during mechanical pulping, e.g., due to the physical abrasion and thermal energy emitted from the process, and to improve pulp strength properties and reduce refining energy in some cases.

Conventional CMP processes may involve pre-treatment of the materials before fiberization to form fiber bundles and separate fibers. Fiberization mechanically reduces lignocellulosic material into their fiber component elements. In one type of pretreatment process, chips may be pretreated by being fed through a compression screw device where saturated steam is present. After compression, the lignocellulosic material is fed into a fiberizer where the material is optionally treated with chemicals, then fibrillated. Fibrillation relates to a process that may include the external disruption of lateral bonds between surface layers of a fiber that results in partial detachment of fibers or small pieces of the outer layers of the fiber and the internal or lateral bonds between adjacent layers within a fiber and usually occurs during the mechanical refining of pulp slurries. In another type of CMP process, pulp may be manufactured through pre-treating lignocellulosic material after compression but before entering the fiberizer.

Utilization of chemical pretreatment processes of the lignocellulosic material before fiberization is believed to yield higher quantity of quality pulp that has better bleachability, fiber-bonding strength, and optical properties. Chemical pretreatment chemicals may include alkaline peroxide, alkaline sulfite, caustic soda, and oxalic acid as reflected in the U.S. Pat. No. 8,092,647, the contents of which are incorporated by reference herein. Chemical pretreatment of lignocellulosic materials using alkaline peroxide chemicals is known as Alkaline Peroxide Mechanical Pulping (APMP).

One type of APMP involves a combination of an AP (Alkaline Peroxide) chemical pretreatment (or pre-conditioning) step with an AP Refiner-chemical treatment step, which may be known as the "P-RC APMP" process in the industry. AP chemicals may be distributed throughout the process (e.g., at the impregnation stage, before the refiner, and after the refiner) to reduce the impact of harsh conditions on the lignocellulosic material undergoing mechanical refining, and to reduce energy consumptions needed for the refining. Due to possible difficulties in achieving chemical distribution and efficiency at the pretreatment stage, chemicals may also be added after the primary refining stage where a significant amount of energy is spent on fiberization and fibrillation. Consequently, AP chemicals added after the primary refiner stage may not aid in the reduction of energy consumption needed for fiberization and fibrillation at the primary refiner stage.

Known P-RC APMP processes may use a chip press, screw compression, and/or other types of compression device in the pretreatment step. It is believed that P-RC APMP processes have improved APMP processes by improving chemical distribution and efficiency of equipment using the pretreatment devices for chemical impregnation of the lignocellulosic material before being refined. But it is also believed that this pretreatment in P-RC APMP processes pose potential problems of non-uniform and uneven distribution of chemicals due to the variations in lignocellulosic material sizes and degrees of macerations. Maceration relates to a process that may include softening and separation of wood chips or fiber bundles into their component parts by the application of physical mechanical treatment.

Known processes are reflected in U.S. Patent Nos. 7,300,541; 7,300,540; 7,300,550; 8,048,263; and 8,216,423.

In an effort to address the potential shortcomings of the current P-RC APMP and other APMP processes, the current disclosure seeks to provide an improved system and method for chemical mechanical pulping.

SUMMARY OF THE DISCLOSURE

The present disclosure generally relates to an effort to address and improve possible shortcomings of the conventional chemical mechanical pulping process. An embodiment may comprise: a fiberizer configured to receive lignocellulosic material; a retention apparatus configured to receive fiberized lignocellulosic material, which is operatively connected to the fiberizer, with or without a mixing device configured to receive fiberized lignocellulosic material and to add alkaline peroxide chemical to the fiberized lignocellulosic material, which is operatively connected to the retention apparatus; and a retention tower configured to receive alkaline peroxide treated lignocellulosic material, which is operatively connected to the mixing device. The lignocellulosic material, e.g., wood chips, is not chemically impregnated either shortly before and/or as entering the fiberizer. The chemically untreated lignocellulosic material also may undergo other pretreatment such as compression washing and dewatering prior to entering the fiberizer.

Accordingly, the present application discloses a chemical mechanical pulping process utilizing an embodiment of a chemical mechanical pulping system comprising: feeding lignocellulosic material into the fiberizer; fiberizing the lignocellulosic material to form bundles of fiber; diluting the bundles of fiber to form an aggregate of wet fiber bundles; retaining the aggregate of wet fiber bundles for a first predetermined time; adding alkaline peroxide chemical and predetermined peroxide stabilizing agents to the aggregate of wet fiber bundles; and retaining the alkaline peroxide treated aggregate of wet fiber bundles in a retention tower for a second predetermined time. The lignocellulosic material is not chemically impregnated before fiberizing. The lignocellulose material also may undergo other pretreatment such as compression washing and dewatering prior to fiberization The present disclosure generally relates to a system and method of producing pulp through conducting chemical treatment of the lignocellulosic materials after the lignocellulosic materials undergo fiberization. There may be steps of washing and dewatering, and steaming, of the lignocellulosic materials before fiberization. But there is no chemical impregnation of the lignocellulosic materials before fiberization. Chemical treatment of fiber bundles obtained after fiberization may provide a more uniformly distributed application of the alkaline peroxide chemical to the fiber bundles before undergoing fibrillation. When compared to the conventional P-RC APMP, it is believed that the disclosed system and process may require 10% to 30% less specific energy consumption, and may consume 10% to 20% less peroxide chemical to produce a similar pulp.

DETAILED DESCRIPTION OF THE PREFERRED EMBODIMENTS

Figure 1:
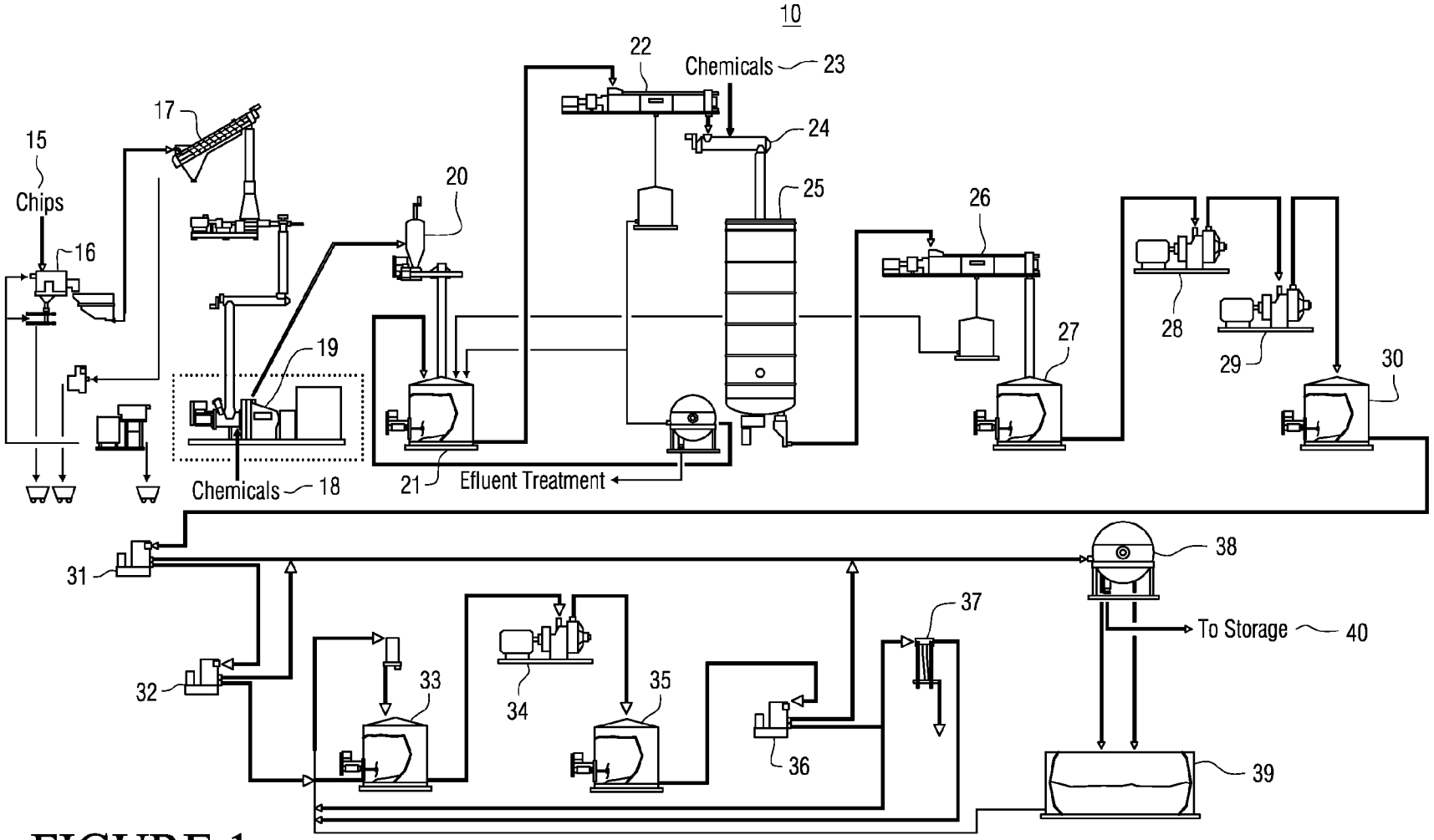
FIG. 1 is a schematic representation of a system in accordance with the present disclosure.

FIG. 1 schematically illustrates a system 10. The lignocellulosic material enters the system via line 15 (e.g., wood chips, or "chips" as well as other material having lignin and cellulose) may enter a chip washer 16 to remove impurities. The washed lignocellulosic material may then enter a dewatering screw 17, with or without pressure, to remove excess liquid before entering a fiberizer 19. Another embodiment of the system may not include a washer 16 and dewatering screw 17, or may include other devices configured to perform impurities removal from the lignocellulosic material. Another embodiment of the system may also include a steaming device configured to receive and steam the lignocellulosic material upstream from the fiberizer 19. The lignocellulosic material received by the fiberizer 19, with or without undergoing steam and wash, is not chemically impregnated, and may not undergo compression by a compression device, maceration by a compression device, or a combination thereof, before entering the fiberizer 19.

In one embodiment, the chemically untreated lignocellulosic material may enter the fiberizer 19 and undergo fiberization in the absence of chemicals, e.g., alkali chemicals and alkaline peroxide chemicals.

In another embodiment, a chemical 18, e.g., an alkali chemical, including sodium hydroxide or other forms of alkaline chemicals without peroxide, is added at an inlet, near an inlet, e.g., in a pipeline or vessel immediately before an inlet, or at a refining zone of the fiberizer 19, with or without chelating agents, e.g., diethylenetriamine pentaacetic acid (DTPA) or ethylenedinitrilotetraacetic acid (EDTA). The alkali chemical may aid in softening of the fiber structure of the lignocellulosic material by promoting hydrolysis of hemicellulose in and between the fiber walls, neutralizing acid groups in the material, and making extractives, and other potentially harmful substance to peroxide bleaching, more soluble.

A further embodiment may include the addition of a chemical 18, e.g., an alkali chemical and/or an alkaline peroxide chemical, at an inlet, near an inlet, or at a refining zone of the fiberizer 19. The fiberizer 19 may be pressurized to certain predetermined pressures, e.g., pressures at gauge values between about 1 bar to about or even more than 6 bars, including about 2 bars to about 4 bars, and all subranges therebetween The lignocellulosic material discharged from the fiberizer 19 may substantially comprise of fiber bundles, with little or no fibrillation, that may be small enough to allow for ease of chemical penetration and distribution. Fiber bundles mentioned in this disclosure consist of a group of two or more fibers that are chemically bonded by the original chemical bonding among the fibers themselves. The fiber bundles mentioned in this disclosure are different from fiber bundles formed by already chemically separated fibers.

The fiberized material, e.g., fiber bundles, with or without alkali chemical 18, may be diluted at the discharge of the fiberizer 19 to produce an aggregate of wet fiber bundles with a solids concentration of between about 1% to about 30%, including about 1% to about 25%, including about 2% to about 20%, about 4% to about 18%, about 8% to about 12%, and all subranges therebetween. At a consistency of less than 10% solids concentration, the aggregate of wet fiber bundles may have properties relating to a slurry. In another embodiment, at the discharge of the fiberizer 19 wherein the fiberized material has a solids concentration in or above the range mentioned above, no dilution may be needed.

The aggregate of wet fiber bundles may be retained in a retention vessel 21 for a retention time of between about or even less than 1 minute to about or even more than 20 minutes, about 3 minutes to about 16 minutes, about 6 minutes to about 10 minutes, and all subranges therebetween. The retention time may depend on e.g., the amount of alkali chemical 18 added at the fiberizer 19, and on the nature of the lignocellulosic material. The retention step may be performed in a dilution vessel 20, a retention vessel 21 with or without a rotor, in a transfer pipe, or in other types of conduits that may receive and allow retention of the aggregate of wet fiber bundles.

The resulting aggregate of wet fiber bundles after dilution may be subjected to washing and/or dewatering by using any suitable dewatering equipment 22, e.g., a screw press or similar device that removes water from the aggregate of wet fiber bundles. The dewatered aggregate of wet fiber bundles may become chemically treated fiber bundles. After dewatering, one or more alkaline peroxide chemicals 23, and necessary stabilizing agents, e.g., DTPA, EDTA, silicate, and $MgSO_4$, may be added to the fiber bundles in a mixing device 24, then retained in a retention tower 25 for sufficient time for the alkaline peroxide chemical 23 to complete reaction.

The alkaline chemical portion of the alkaline peroxide chemicals 23 can be sodium hydroxide, sodium carbonate, or other alkaline chemical, e.g., magnesium oxide, magnesium hydroxide, and white or green liquor recovered from the pulping process. The alkaline chemical may be in the amount ranging from about or even less than 1% to about or even more than 10%, including about 2% to about 8%, about 4% to about 6%, and all the subranges therebetween, based on the oven dry weight of the lignocellulosic material. The peroxide chemical portion of the alkaline peroxide chemical 23 can be hydrogen peroxide, or other suitable peroxide chemical, e.g., per-acetic acid and per-carbonic acid, in the amount ranging from about 0.5% to about or even more than 10%, including about 2% to about 7.5%, about 4% to about 5.5%, and all the subranges therebetween, based on the oven dry weight of the lignocellulosic material. The amount of the alkaline and peroxide chemicals present in the alkaline peroxide chemical 23 may depend upon the specific types of lignocellulosic material that enters line 15 and the desired pulp properties, e.g., the brightness and strength of the final pulp.

The retention tower 25 may consist of a low consistency, medium consistency, or high consistency vessel to accommodate the alkaline peroxide treated fiber bundles depending on the alkaline peroxide chemical 23 and a resulting consistency from the treatment. The retention time depends upon the amount and concentration of alkaline peroxide chemical 23 and the type of lignocellulosic material that enters line 15 to be used in the process.

After the material leaves the retention tower 25, the material may be subjected to further compression and refining, e.g., using a screw press 26 and tank 27, and pass through a first refiner 28, a second refiner 29, a tank or mixer 30, screening devices or other filtration devices 31 and 32, rejects handling system including tank 33, refiner 34, tank 35, screening device 36, filtration device 38, and sent to pulp storage 40.

In another embodiment, the material may be subjected to a screening device or other filtration device 31, filtration device 38, and sent to pulp storage 40.

In yet another embodiment, the material may be subjected to filtration device 38 for a first time, liquid storage 39, rejects handling system including tank 33, refiner 34, tank 35, screening device 36, filtration device 38 for a second time, and sent to pulp storage 40.

In an additional embodiment, the material may also undergo a second alkaline peroxide treatment process after leaving the retention tower, e.g., second alkaline peroxide chemical and predetermined peroxide stabilizing agents addition using a second mixing device, and retained at a second retention tower for a third predetermined time, before the material is sent to further compression and refining and other processing such as bleaching. There may be multiple bleaching stages such as medium consistency bleaching, high consistency bleaching or other suitable stages.

Figure 2:
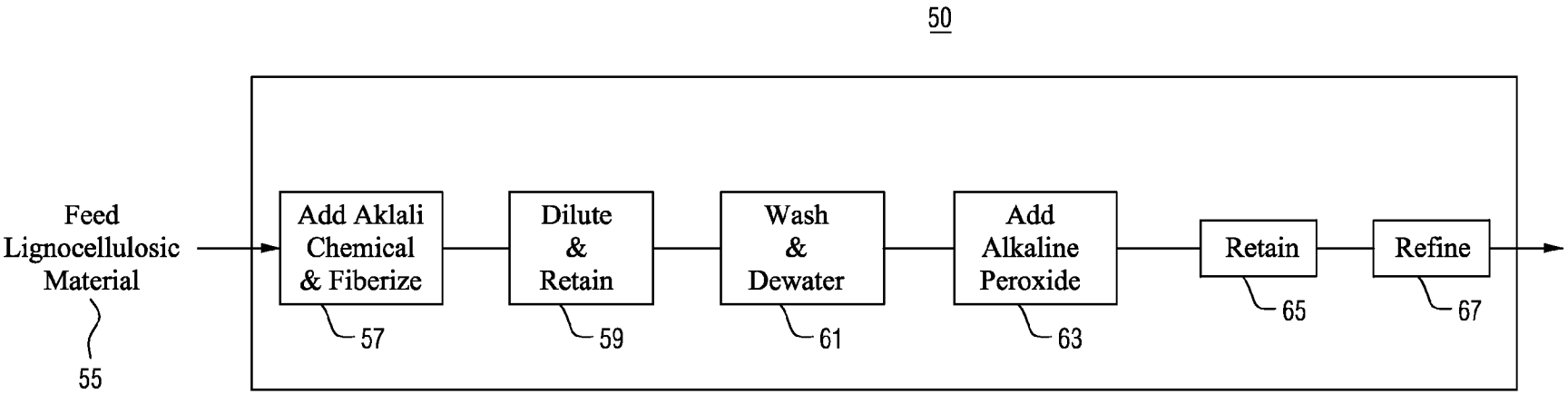
FIG. 2 is a process diagram of a method that may be performed in accordance with the present disclosure.

FIG. 2 shows a method 50 utilizing a process in which lignocellulosic material may be fed 55 directly for fiberization 57. The lignocellulosic material may be washed and dewatered using a compression device prior to fiberization 57. The wash may be performed to remove dirt, rocks, or other unwanted impurities in the lignocellulosic material. The lignocellulosic material is not chemically impregnated before fiberization.

In one embodiment, the chemically untreated lignocellulosic material undergoes fiberization 57 in the presence of an alkali chemical. The alkali chemical aids in softening of the fiber structure of the lignocellulosic material by promoting hydrolysis of hemicellulose in and between the fiber walls, neutralizing acid groups in the material, and making extractives, and other potentially harmful substance to peroxide bleaching, more soluble. Chelating agents, e.g., DTPA and EDTA, may also be added with the alkali chemical to chelate the transition metals in the lignocellulosic material that are harmful to peroxide bleaching reactions for easier removal of the metals in subsequent stages. Alternatively, the chelating agents may also be added to cause the transition metals to become unreactive to the peroxide bleaching agents in the subsequent bleaching stages.

In another embodiment, the chemically untreated lignocellulosic material may be fiberized with an absence of chemical, e.g., alkali and alkaline peroxide chemical. In a further embodiment, the chemically untreated lignocellulosic material may be fiberized in the presence of an alkali chemical and/or an alkaline chemical.

The fiber bundles formed from fiberization 57 may undergo dilution and retention 59 to produce an aggregate of wet fiber bundles with a solids concentration of between about 1% to about 30%, including about 1% to about 25%, including about 2% to about 20%, about 4% to about 18%, about 8% to about 12%, and all subranges therebetween. At a solids concentration of less than 10%, the aggregate of wet fiber bundles may relate to the properties of a slurry. The aggregate of wet fiber bundles may be retained for a certain range of time from about or even less than 1 minute to about or even more than 20 minutes, including about 1 minute to about 20 minutes, about 3 minutes to about 16 minutes, about 6 minutes to about 10 minutes, and all subranges therebetween.

The aggregate of wet fiber bundles may be diluted and retained 59 in a vessel or in a transfer pipe, e.g., a blow line pipe, after fiberization 57. After dilution and retention 59, the aggregate of wet fiber bundles may undergo washing and dewatering to remove extractives and transition metals from the aforementioned chemical treatment, to form washed and dewatered fiber bundles.

Addition of alkaline peroxide chemicals 63, and other necessary peroxide stabilizing agents, may be performed using a mixing device that distributes the chemicals to the washed and dewatered fiber bundles.

The alkaline portion of the alkaline peroxide chemical in step 63 can be sodium hydroxide, sodium carbonate, or other alkaline chemical, e.g., magnesium oxide, magnesium hydroxide, and white or green liquor recovered from the pulping process. Based on oven dry weight of the lignocellulosic material, the amount of alkaline chemical used may be in the range of about or even less than 1% to about or even more than 10%, including about 2% to about 8%, about 4% to about 6%, and all the subranges therebetween.

The peroxide portion of the alkaline peroxide chemical in step 63 can be hydrogen peroxide, or other suitable peroxide chemical, in the range of 0.5% to about or even more than 10%, including about 2% to about 7.5%, about 4% to about 5.5%, and all the subranges therebetween, based on oven dry weight of the fiber material. The amount of the alkaline and peroxide chemicals present in the alkaline peroxide chemical may depend upon the specific lignocellulosic material fed 55 in the process and the desired pulp properties, e.g., the brightness and strength of the final pulp.

After alkaline peroxide addition 63, the fiber bundles with alkaline peroxide may enter a retention tower to be retained 65. The retention tower may be a vessel, a conduit connecting between vessels, or a combination thereof. The material may be retained 65 for a sufficient time to allow the added alkaline peroxide chemicals 63 to be consumed by the fiber bundles and become treated fiber bundles.

After the treated fiber bundles leaves the retention tower in step 65, the treated fiber bundles may enter the conventional refining process 67 where the treated fiber bundles will be further refined in a low consistency, medium consistency, or high consistency refining equipment and undergo further refining stages including conventional screening, reject handling, thickening, and post bleaching. Post bleaching may include, but not be limited to, multiple stage bleaching such as medium consistency, high consistency bleaching, or any combination thereof. In another embodiment, the material may also undergo a second alkaline peroxide treatment process after leaving the retention tower (stage 67), e.g., second alkaline peroxide addition using a second mixing device, and retained at a second retention tower, before the material is sent to further compression and refinery.

A preferred method of the present disclosure may also include steaming the lignocellulosic material, with or without washing, before the lignocellulosic is fiberized 57. Another preferred method of the present disclosure may also have an additional buffering vessel where lignocellulosic material is kept after being washed and dewatered, and before going through fiberization 57.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A chemical mechanical pulping process comprising:

feeding lignocellulosic material into a fiberizer;

fiberizing lignocellulosic material to form bundles of fiber;

diluting bundles of fiber to form an aggregate of wet fiber bundles;

retaining the aggregate of wet fiber bundles for a first predetermined time;

adding alkaline peroxide chemical and peroxide stabilizing agents to the aggregate of wet fiber bundles thereby forming an alkaline peroxide treated aggregate of wet fiber bundles; and retaining the alkaline peroxide treated aggregate of wet fiber bundles in a retention tower for a second predetermined time, wherein lignocellulosic material is not chemically impregnated before fiberizing, and wherein no refiner is used between forming of bundles of fiber and retaining the alkaline peroxide treated aggregate of wet fiber bundles in a retention tower for a second predetermined time.

2. The chemical mechanical pulping process of claim 1 further comprising washing and dewatering untreated lignocellulosic material before feeding the lignocellulosic material into the fiberizer.

3. The chemical mechanical pulping process of claim 1, wherein the aggregate of wet fiber bundles has a solids concentration of about 1% to about 30%.

4. The chemical mechanical pulping process of claim 1, wherein the retention time of the aggregate of wet fiber bundles is between about 1 minute to about 20 minutes, wherein the aggregate of wet fiber bundles is retained in a vessel.

5. The chemical mechanical pulping process of claim 1, wherein the alkaline peroxide chemical comprises an alkaline chemical in a range of about 1% to about 10%, based on an oven dry weight of the lignocellulosic material.

6. The chemical mechanical pulping process of claim 1, wherein the alkaline chemical comprises at least one of sodium hydroxide, sodium carbonate, magnesium oxide, magnesium hydroxide, white liquor, green liquor, or a combination thereof.

7. The chemical mechanical pulping process of claim 4, further comprising washing and dewatering the aggregate of wet fiber bundles after retention and before addition of the alkaline peroxide chemical.

8. The chemical mechanical pulping process of claim 1 further comprising a refining step selected from the group consisting of low consistency refining, medium consistency refining, high consistency refining, low consistency refining and high consistency refining, low consistency refining and medium consistency refining, and medium consistency refining and high consistency refining, wherein the refining step is followed by screening, reject handling, pulp thickening, and post bleaching.

9. The chemical mechanical pulping system of claim 8, wherein the post bleaching is selected from the group consisting of multiple bleaching steps for medium bleaching consistency, multiple bleaching steps for high bleaching consistency, and a combination thereof.

10. The chemical mechanical pulping process of claim 1 further comprising steaming lignocellulosic material before the lignocellulosic material enters the fiberizer.

11. The chemical mechanical pulping process of claim 1 further comprising retaining lignocellulosic material in a buffering vessel before the lignocellulosic material enters the fiberizer.

12. The chemical mechanical pulping process of claim 1 further comprising:

undergoing a second alkaline treatment process, wherein the second alkaline treatment process comprises adding a second alkaline peroxide chemical and peroxide stabilizing agents to the alkaline peroxide treated aggregate of wet fiber bundle, wherein the second alkaline peroxide chemical and peroxide stabilizing agents is added after retaining the alkaline peroxide treated aggregate of wet fiber bundles in the retention tower; and retaining the alkaline peroxide treated aggregate of wet fiber bundles and the second alkaline peroxide chemical and peroxide stabilizing agents in a second retention tower for a third predetermined time.

13. The chemical mechanical pulping process of claim 1, wherein the aggregate of wet fiber bundles has a solids concentration of between about 4% to about 18%.

14. The chemical mechanical pulping process of claim 1, wherein the retention time of the aggregate of wet fiber bundles is between about 3 minutes to about 16 minutes, wherein the aggregate of wet fiber bundles is retained in a vessel.

15. The chemical mechanical pulping process of claim 1, wherein the alkaline peroxide chemical comprises an alkaline chemical in a range of about 2% to about 8%, based on an oven dry weight of the lignocellulosic material.

16. The chemical mechanical pulping process of claim 1, wherein the retention time of the aggregate of wet fiber bundles is between about 1 minutes to about 20 minutes, wherein the aggregate of wet fiber bundles is retained in a transfer pipe.

17. The chemical mechanical pulping process of claim 1, wherein the retention time of the aggregate of wet fiber bundles is between about 3 minutes to about 16 minutes, wherein the aggregate of wet fiber bundles is retained in a transfer pipe.

* * * * *